US006692306B1

(12) United States Patent
Chung et al.

(10) Patent No.: US 6,692,306 B1
(45) Date of Patent: Feb. 17, 2004

(54) EXTRACTION DEVICE FOR ELECTRICAL CONNECTOR

(75) Inventors: Yung-Chien Chung, Tu-Chen (TW); Hsien-Chu Lin, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/321,273

(22) Filed: Dec. 16, 2002

(30) Foreign Application Priority Data

Nov. 13, 2002 (TW) ..... 91218158 U

(51) Int. Cl.[7] ..... H01R 9/03

(52) U.S. Cl. ..... 439/610; 439/607; 439/608; 439/352; 439/357; 174/74 R

(58) Field of Search ..... 439/610, 404, 439/607, 608, 395, 352, 357, 354; 174/74 R

(56) References Cited

U.S. PATENT DOCUMENTS 4,325,599 A * 4/1982 Feldman
5,315,063 A * 5/1994 Auclair
5,564,939 A * 10/1996 Maitani et al.
5,586,906 A * 12/1996 Staros et al.
5,609,498 A * 3/1997 Muzslay
6,091,474 A * 7/2000 Middleton et al.
6,283,793 B1 * 9/2001 Nakata
6,319,075 B1 * 11/2001 Clark et al.

FOREIGN PATENT DOCUMENTS

JP 2001-035592 9/2001

* cited by examiner

*Primary Examiner*—Dean A. Reichard
*Assistant Examiner*—Nguyen T. Ha
(74) *Attorney, Agent, or Firm*—Wei Te Chung

(57) ABSTRACT

An extraction device, mounted on a cable end connector (1), includes a pull tab (3) and a retention element (2). The retention element surrounds peripheries of the pull tab and the cable end connector, thereby securely retaining the pull tab on the cable end connector. Pulling the pull tab, the cable end connector can be pull out of a header (6) which mates with the cable end connector.

13 Claims, 3 Drawing Sheets

EXTRACTION DEVICE FOR ELECTRICAL CONNECTOR

CROSS-REFERENCE TO RELATED APPLICATION

This application is related to a application of patent application Ser. No. 10/120,633, entitled "PULL TAB FOR EXTRACTING ELECTRICAL CONNECTOR", a copending application of patent application entitled "ELECTRICAL CONNECTOR WITH PULL TAB", invented by Yung-Chien Chung, Hsien-Chu Lin and Yu Chieh Chao and a copending application of patent application entitled "ELECTRICAL CONNECTOR WITH EXTRACTION TOOL", invented by Yung-Chien Chung, Hsien-Chu Lin and Yu Chieh Chao.

BACKGROUND OF THE INVENTION

1. Field of the Invention

The present invention relates to an extraction device, and more particularly, to an extraction device for extracting an electrical connector from an electrical device which mates with the electrical connector.

2. Description of Prior Art

To meet a trend of miniature of dimension so as to reach a light, thin, short and small device while still performs excellent functions, many electrical devices tend to employ, small connectors, such as cable end connectors, for transmitting signals. These cable end connectors usually comprise receptacles and cables. The receptacles need to mate tightly with corresponding headers of devices for transmitting signals reliably, which usually requires a great amount of applied withdrawing force to extract these cable end connectors from these headers when necessary. Their separation is normally accomplished by manually shaking the receptacles of the connectors (or perhaps with prying tools) or by manually pulling cables of the connectors when the connectors are pulled away from the headers of the devices. However, the shaking action to the receptacles of the connectors inevitably bends the contacts of the small connectors and damages the connectors and/or the headers of the devices. It is also difficult to manually pull a receptacle of a connector having a very small size. The pulling action to the cables of the connectors may pull the cables out from the connectors.

In order to solve the above-mentioned problems, U.S. Pat. No. 4,961,256 issued to Faillace on Oct. 9, 1990 discloses a conventional extraction tool. To separate a plug from a receptacle, the extraction tool is inserted between the plug and the receptacle. The tool is relatively thick so that it cannot be used for the present miniaturized plug since there is no space large enough between the plug and the receptacle to accommodate the tool.

Japanese Publication for Laid-Open Patent Application No. 11-208461 discloses an extraction tab for extracting an L-type connector. The L-type connector comprises an upright mating portion, a horizontal cable-retaining portion and a cable. The extraction tab defines an aperture in a front end thereof and a hole in a middle portion thereof. A handle portion is formed on a rear end of the extraction tab. The aperture of the extraction tab mates with the mating portion of the L-type connector and the hole mates with the cable-retaining portion, thereby assembling the extraction tab on the L-type connector. However, because the L-type connector extends through the extraction tab twice, the extraction tab is in a state of bend and is inconvenient to assemble on the L-type connector. As a result, the handle portion of the extraction tab is tilted over the L-type connector and cannot be steadily mounted on the L-type connector.

Hence, an improved extraction tool is desired to overcome the above-mentioned shortcomings.

BRIEF SUMMARY OF THE INVENTION

A main object of the present invention is to provide an extraction device which is capable of being conveniently and steadily mounted on an electrical connector.

An extraction device in accordance with the present invention for extracting a cable end connector from a header which mates with the cable end connector, includes a pull tab and a retention element. The pull tab has a strip-like configuration and comprises an engaging portion and a handling portion. The retention element interferentially surrounds a cable-retaining portion of the cable end connector and the engaging portion of the pull tab, thereby securely mounting the pull tab on the cable end connector.

In use, by pulling the handling portion of the pull tab upwardly, the cable end connector can be easily extracted from the header.

Being restricted on the cable end connector by the retention element, the pull tab keeps straight and can be steadily mounted on the cable end connector. It is also convenient for mounting the pull tab on the cable end connector.

Other objects, advantages and novel features of the invention will become more apparent from the following detailed description when taken in conjunction with the accompanying drawings.

DETAILED DESCRIPTION OF THE INVENTION

Figure 1:
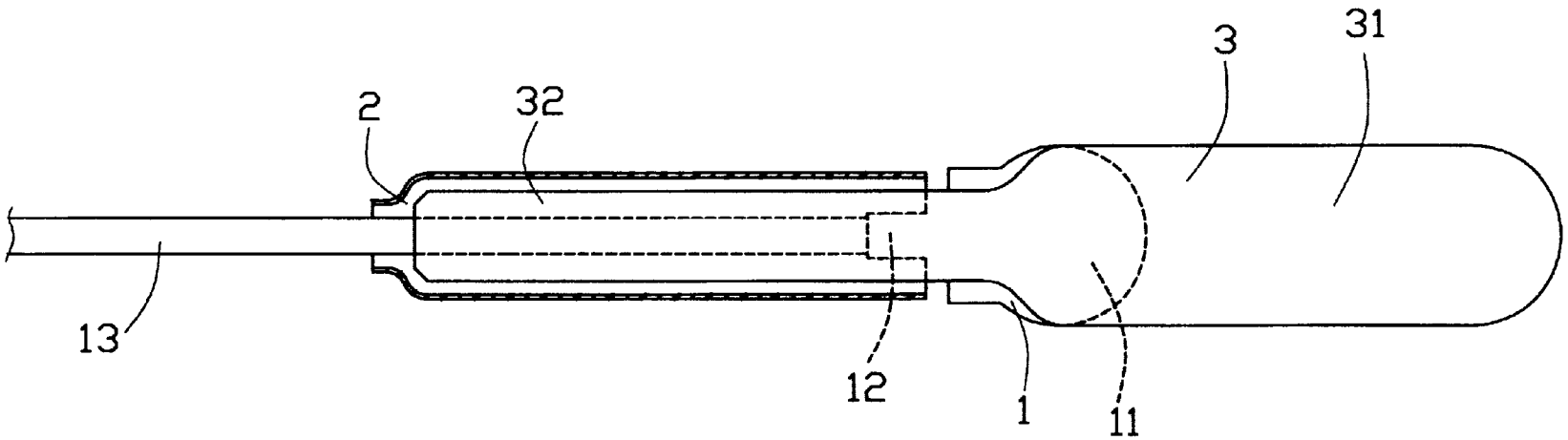
FIG. 1 is a top view of an extraction device according to a preferred embodiment of the present invention, wherein the extraction device is mounted on a cable end connector, with a part of retention element removed for clarity.
Figure 2:
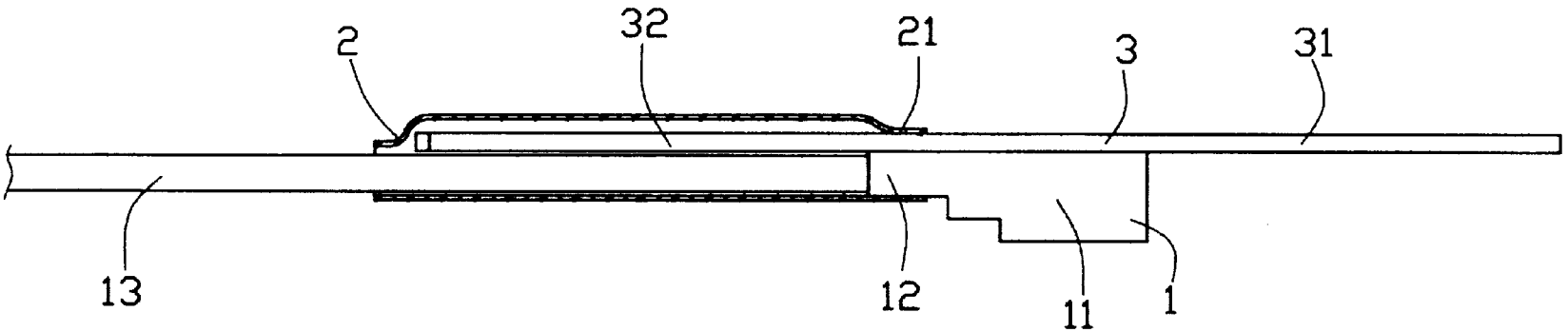
FIG. 2 is a side view of the extraction device of the present invention, wherein the extraction device is mounted on the cable end connector, with a part of retention element removed for clarity.
Figure 3:
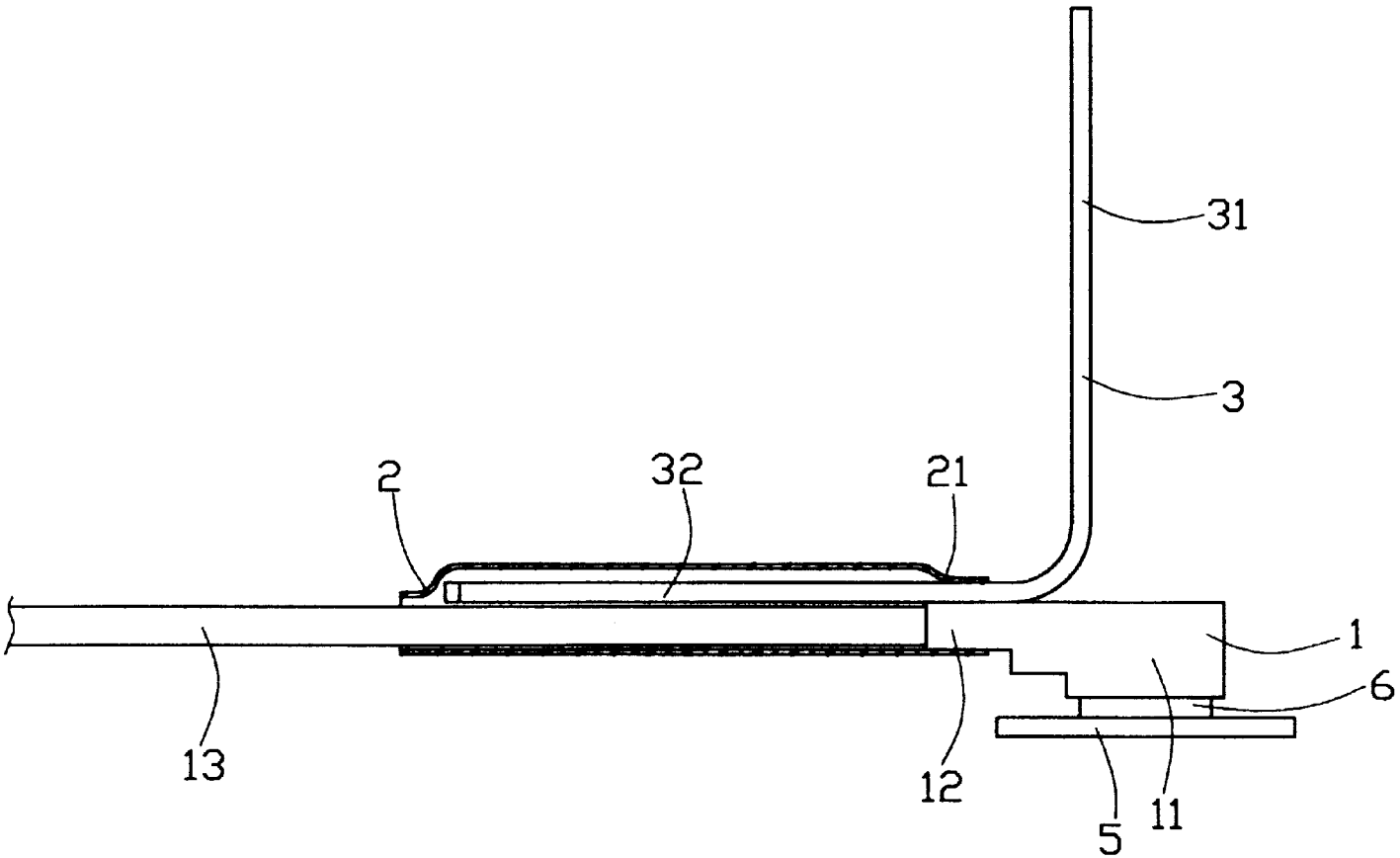
FIG. 3 is a view similar to FIG. 2, illustrating a pull tab of the present invention in a state ready to be used to extract the cable end connector from a header which mates with the cable end connector.

Referring to FIGS. 1–3, an extraction device according to the present invention is attached to an electrical connector for removing the electrical connector from a mating electrical device. In this preferred embodiment, the electrical connector is a cable end connector 1 comprising an upright mating receptacle 11, a horizontal cable-retaining portion 12 and a cable 13. The mating electrical device is a header 6 (shown in FIG. 3) mounted on a printed circuit board 5.

The extraction device comprises a pull tab 3 made of flexible material and a retention element 2. The pull tab 3 has an elongate and strip-like configuration and comprises a handling portion 31 and an engaging portion 32. The retention element 2, in this preferred embodiment, is an elongate sleeve (shown in FIGS. 1–3). The sleeve 2 forms a grasping end 21 on an end thereof.

In assembly, the pull tab 3 horizontally lies on the cable end connector 1, wherein the engaging portion 32 lies on the cable-retaining portion 12 and the cable 13, and the handling portion 31 lies on the mating receptacle 11. The retention element 2 interferentially surrounds the cable-retaining portion 12 and the engaging portion 32 of the pull tab 3, the grasping end 21 grasping the cable-retaining portion 12 and the engaging portion 32, thereby securely mounting the pull tab 3 on the cable end connector 1.

In use, holding and upwardly pulling the handling portion 31 of the pull tab 3, the engaging portion 32 exerts an upper lifting force on the grasping end 21 of the retention element 2. As a result, the retention element 2 exerts extracting force on the cable-retaining portion 12, thereby upwardly separating the cable end connector 1 from the header 6.

The retention element 2 can also be an elongate strip-like portion (not shown), such as adhesive tape. In assembly, the strip-like portion binds the engaging portion 32 and the cable-retaining portion 12 together, thereby securely mounting the pull tab 3 on the cable end connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A connector system comprising:

a first electrical connector;

a second electrical connector adapted for mating with the first electrical connector, the second electrical connector comprising a mating portion and a cable-retaining portion; and an extraction device for extracting the second electrical connector from the first electrical connector, the extraction device comprising a pull tab and a retention element, the retention element forming a closed loop surrounding the pull tab and the second electrical connector therein, thereby retaining the pull tab on the second electrical connector.

2. The extraction device as claimed in claim 1, wherein the pull tab is made of resilient material and comprises a handling portion and an engaging portion.

3. The extraction device as claimed in claim 2, wherein the retention element is a sleeve, and wherein the engaging portion of the pull tab is retained in the sleeve.

4. The extraction device as claimed in claim 3, wherein the retention element forms a grasping end securely retaining the pull tab on the cable-retaining portion of the second electrical connector.

5. The extraction device as claimed in claim 2, wherein the retention element is an elongate strip-like portion wrapping around the pull tab and the cable-retaining portion of the second electrical connector together.

6. A cable assembly comprising:

a cable end connector comprising a mating portion and a cable-retaining portion; and an extraction device comprising a pull tab and a retention element, the retention element enclosing the pull tab and the cable end connector, thereby retaining the pull tab on the cable end connector.

7. The cable assembly as claimed in claim 6, wherein the retention element is a sleeve securely restricting the pull tab and the cable-retaining portion of the cable end connector therein.

8. The cable assembly as claimed in claim 6, wherein the retention element is an elongate strip securely bending the pull tab and the cable-retaining portion together.

9. The cable assembly as claimed in claim 6, wherein the pull tab has an elongate and strip-like configuration and comprises a handling portion and an engaging portion.

10. A cable end connector assembly comprising:

an electrical connector including an upright mating port and a cable integrally extending horizontally from an upper portion of said mating port;

a flexible pull tab extending along an axial direction of said cable and disposed on upper portions of said mating port and said cable, said pull tab extending forwardly beyond said mating port with a first distance and rearwardly with a second distance along said cable; and a grasping device fixedly securing the said pull tab to said cable with a third distance along said cable.

11. The assembly as claimed in claimed 10, wherein said third distance is substantially equal to said second distance.

12. The assembly as claimed in claimed 10, wherein said first distance is substantially equal to said second distance.

13. The assembly as claimed in claim 10, wherein said pull tab is not directly fastened to the mating port.

* * * * *